United States Patent [19]

Bergler et al.

[11] 4,024,898

[45] May 24, 1977

[54] ANGULAR GUIDE FOR MANUAL ROUTING MILLING MACHINES

[75] Inventors: Otto Bergler; Eugen Lutz, both of Muhlacker-Lomersheim, Germany

[73] Assignee: Eugene Lutz KG Maschinenfabrik Lomersheim, Muehlacker, Germany

[22] Filed: May 7, 1975

[21] Appl. No.: 575,269

[30] Foreign Application Priority Data

May 7, 1974 Germany ..... 2421954

[52] U.S. Cl. ..... 144/134 D; 90/12 D; 144/136 C; 144/251 A; 144/253 R; 144/287

[51] Int. Cl.[2] ..... B27C 5/10; B27C 9/02

[58] Field of Search ..... 90/12 D; 144/1 F, 3 R, 144/35 A, 134 A, 134 D, 136 R, 136 C, 136 D, 253 R, 253 A, 253 J, 287, 251 R, 251 A; 408/712

[56] References Cited

UNITED STATES PATENTS

| | | | |
|---|---|---|---|
| 1,506,154 | 8/1924 | Berthelsen | 144/136 C X |
| 1,532,683 | 4/1925 | Carter | 144/3 R X |
| 1,989,285 | 1/1935 | Merrigan | 144/251 A |
| 2,076,511 | 4/1937 | Hedgpeth | 144/134 A |
| 2,799,305 | 7/1957 | Groehn | 144/253 R |
| 3,478,788 | 11/1969 | Zelik | 144/134 D |

FOREIGN PATENTS OR APPLICATIONS

| | | | |
|---|---|---|---|
| 855,159 | 11/1952 | Germany | 144/253 R |
| 88,108 | 12/1936 | Sweden | 144/253 R |

*Primary Examiner*—Gary L. Smith
*Attorney, Agent, or Firm*—Craig & Antonelli

[57] ABSTRACT

An angular guide for hand routing millers formed of two legs forming an angle of 90° with one another, one of the legs being fashioned as a stop plate with a smooth guiding surface and the other of the legs being constructed as a mounting plate with holding members arranged on its outside for accommodating the routing miller. Both of the legs are provided in the zone of the apex of the angle with apertures to pass the milling tool therethrough. The mounting plate is extended beyong the apex and is likewise formed as a guiding surface at least on the side facing the smooth guiding surface of the stop plate. Various mounting apertures and other members are provided on the stop and mounting plates to accommodate utilization of the angle guide in a plurality of different positions, including use of the mounting plate alone.

24 Claims, 6 Drawing Figures

ANGULAR GUIDE FOR MANUAL ROUTING MILLING MACHINES

BACKGROUND OF THE INVENTION

This invention relates to an angular guide for manual routing millers, consisting of two legs forming an angle of 90°, one of these legs being fashioned as a stop plate with a smooth guiding surface, and the other of these legs being constructed as a mounting plate with holding members or points arranged on its outside for the routing miller, both of these legs being provided, in the zone of the apex of the angle, with apertures to pass the milling tool therethrough.

Such attachments for manual routing millers, called angle stops, are conventional. They have been created due to the need for making manual routing millers usable for homeworkers or for building assembly operations within the wide ranges. The known types of angle stop structures provide a fixed angular profile affording a firm guidance of the routing miller when working on edges of boards or plates, for example when mortising fittings and rabbets, or the like. The disadvantage of these known angle stops is to be seen, on the one hand, in that they are operable exclusively for the just-mentioned procedures, and that special guide plates are required, for example, in case strips for glueing are to be milled flush. In this connection, these guide plates are to be guided only so that the tools work in a face cutting operation which frequently leads to chipping in case of a synthetic resin and also when working on wood. An additional parallel stop becomes necessary if the routing miller is to be used, for example, during the working of edges or the like. A separate table unit as an accessory part is required if fillets are to be profiled or if contours, etc., are to be milled into workpieces. Accordingly, the expenditure for rendering the conventional manual routing millers usable for various fields becomes very large, and it is also, above all, impractical to have to carry along too many separate attachements, not considering the fact that, for example, a table unit cannot be realized in the form of a portable part in conjunction with the conventional types of construction. Additionally, the routing miller, in case of the known angle stops, can be mounted only to overhung rods, which impairs the machining accuracy.

The present invention contemplates fashioning an angular guide of the type mentioned in the foregoing so that a universally usable accessory part for manual routing millers is produced which decisively broadens the field of use for manual routing millers in the from of a portable tool.

Starting with an angular guide of the aforementioned type, the present invention contemplates providing that the leg constructed as a mounting plate is extended past the apex and is formed, at least on the side facing the smooth guiding side of the stop plate, likewise as a guiding surface. Thereby, an angular corner is produced having a stop edge, making it possible to accomplish a large portion of the operations heretofore to be executed by means of separate attachments by means of a single accessory part. The novel angle table is usable as a parallel stop and has the advantage that the extended leg offers also a second mounting possibility for the routing miller and for the arrangement of a fine-adjustment device.

It is advantageously contemplated by the invention to attach the stop plate removably to the mounting plate; at least along one end face of the latter. Along the end faces extending in parallel to the stop plate, the mounting plate is provided with support surfaces for setting up on and clamping to a workbench or the like. By this construction, it becomes possible to use the novel angular guide in a stationary arrangement as a table support for the routing miller, and also as an enlarged guide surface for the manual routing miller, namely in a function as parallel stop as well as for increasing the stability of the guide frame of the routing miller. The latter feature can be attained by removing the stop plate.

It is a further advantageous feature of the invention to provide the cutout for the milling tool as arranged approximately in the center of the mounting plate and to provide connection provisions for at least three upright columns on the side of the mounting plate oppositely to the stop plate. For in this way it becomes additionally possible to use the mounting plate proper as the table, so that by means of one accessory part for hand routing millers quite a number of functions can be fulfilled which heretofore could only be attained by attachments to be provided separately in each individual case.

Additional advantages and details can be seen from the dependent claims appended hereto wherein a particularly advantageous arrangement can be constructed by providing that the holders for the routing miller consist of rods extending in parallel to each other and that, between the holding eyes provided for these rods, bifurcate recesses are arranged to receive a setscrew mounted in parallel to the rods for shifting the routing miller for the purpose of adjusting the cutting depth of the milling tool. In this connection, bolts can also advantageously be arranged for attaching the stop plate; these bolts are inserted at the mounting plate, the stop plate being merely clamped to said bolts. In this way it is possible to arrange the end face of the stop plate facing the mounting plate at a spacing in relation to the mounting plate, so that also the especially advantageous machining of profiles with strips for gluing becomes possible by means of peripherally cutting tools. The construction can be simply such that the clamping action at the mounting bolt is effected by a bracket operable by means of a single wing nut. Therefore, changing the novel angular guide over from one field of use to another is possible only with a few simple manipulations and, for this purpose, the provision can also be made to maintain the holding bolts for the stop plate itself at the mounting plate by means of wing nuts. To attain an exact guidance of the top plate along the mounting plate, the provision can be made at the stop plate that at least one prismatic guide is arranged, on the side fashioned with the handle, for one of the bolts. In this way, an exact positional securement can also be effected by a simple clamping action.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
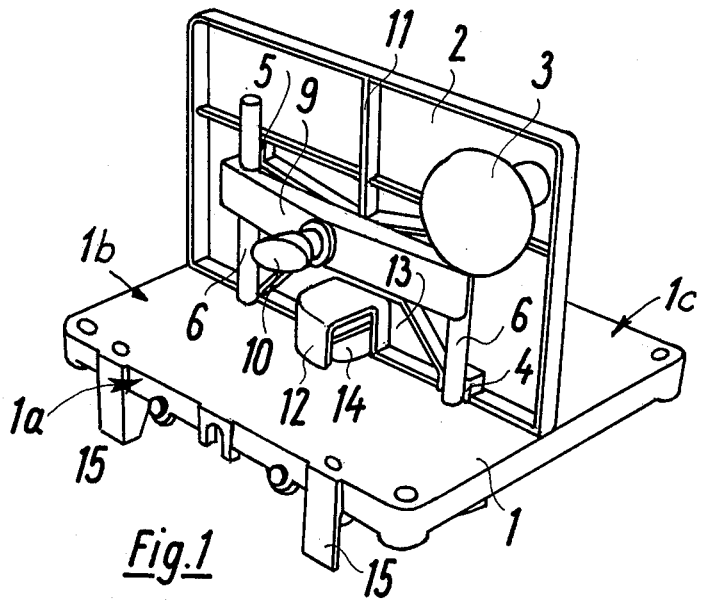
FIG. 1 is a perspective view of the novel angular guide of the present invention, as viewed from the side of the stop plate provided with the handle.
Figure 2:
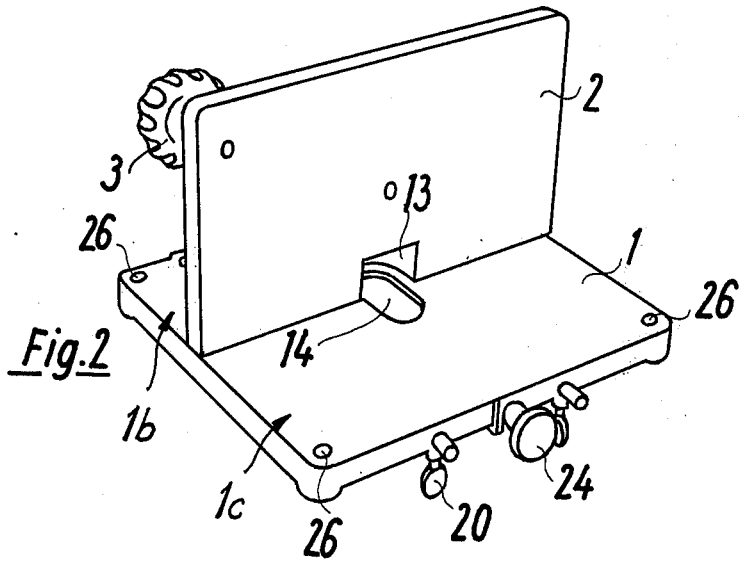
FIG. 2 is a perspective view of the angular guide of FIG. 1, seen from the other side.
Figure 3:
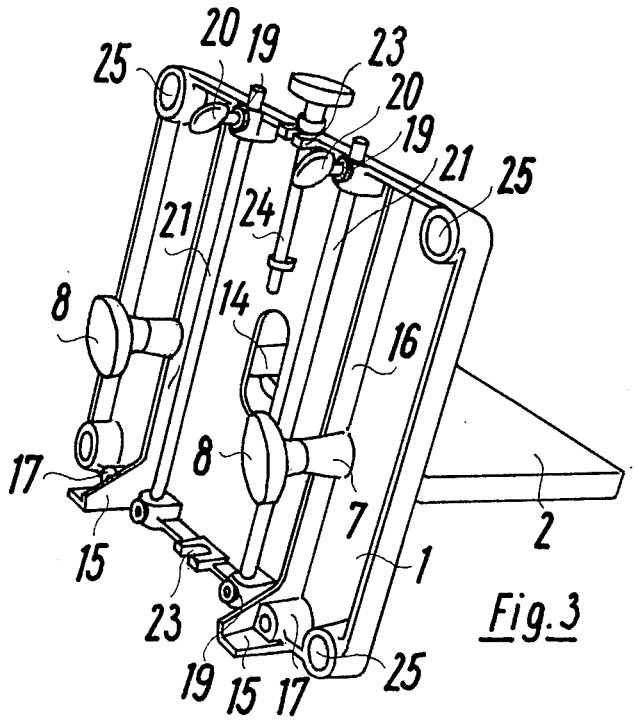
FIG. 3 is a perspective view of the angular guide of FIGS. 1 and 2, seen from the bottom.

In FIGS. 1–3, a stop plate 2 is attached at a right angle to a mounting plate 1. On the side facing the observer in FIG. 1, the stop plate is provided, on the one hand, with a handle 3, which can be detached by threading and, on the other hand, with a prismatic guide 4 and abutment surfaces 5, respectively, for two cylindrical bolts 6 passed, with a threaded pin, which is not visible in FIG. 1, through the mounting plate 1 and through guide extensions 7 mounted to the mounting plate 1. From the underside of the mounting plate 1, these bolts 6 are attached by means of wing nuts 8 made of a synthetic resin. The stop plate 2 is clamped to these bolts 6 with the aid of a bracket 9 pressed against the bolts 6 in its center by way of a wing nut 10, likewise provided with a synthetic resin head, against the bias of a spring not shown in the figure. This clamping action is provided by attaching the wing nut 10 to a threaded pin seated on the stop plate 2. The spring, in this connection, is held on the threaded pin. The stop plate 2 is cast of aluminum and provided with reinforcing ribs 11 on the side facing the observer in FIG. 1. Furthermore, a protective hood 12 is cast integrally with the stop plate, serving as a protection with respect to the cutter extending through the aperture 13 of the stop plate and/or through the aperture 14 of the mounting plate. Prismatic guides 9*a* are also provided at bracket 9 for the bolts 6.

The mounting plate 1 forms an angle of 90° with the stop plate 2 and the part facing the observer. The leg portion 1*b* facing the observer is extended past the edge formed between the stop plate 2 and the surface of the mounting plate 1, where the leg 1*c* forms, with the stop plate 2, a second 90° angle serving as an abutment for the machining of workpieces. The mounting plate 1 is fashioned, for this purpose, to be smooth along its entire side oriented upwardly in FIG. 1, so that guide surfaces are produced. Furthermore, the mounting plate 1 has stabilizing feet 15 on its end face 1*a* oriented toward the left in FIG. 1 and extending in parallel to the stop plate 2. These feet 15 project only toward the side facing away from the stop plate 2.

It can be seen from FIG. 3 that the mounting plate 1 is likewise provided with reinforcing ribs 16, so that it can be manufactured to be relatively lightweight. On the side facing away from the stop plate 2, the mounting plate, however, additionally includes sleeve-like extensions 17 immediately adjacent to the stabilizing feet 15 and suitable for receiving the cylindrical pins of conventional screw clamps 18 (FIG. 5), with the aid of which the mounting plate 1 can then be clamped, for example, to a tabletop.

Eyes 19 with clamping screws 20 for the attachment of rods 21 are provided. The guide frame of the hand routing miller 22 (FIG. 4) can then be placed on these rods 21 in a conventional manner. Bifurcate recesses 23 are included wherein a setscrew 24 is held axially, which setscrew can then be used for shifting the entire manual routing miller assembly in the direction of the rods 21, if the cutting depth of the milling tool extending through the aperture 14 is to be adjusted. The adjustment of the milling tool in a direction in parallel to the stop plate 2 is effected by way of a device arranged directly at the hand routing miller.

Finally, the mounting plate 1, however, also includes, on its four corners, blind holes 25 extended in the upward direction by cylindrical bores 26 of a smaller diameter. These blind holes 25 serve for receiving cylindrical stabilizing columns 27 as provided in FIG. 6 for using the device as a tabletop appliance.

By means of the angular guide constructed as described above, various operations can be executed with a hand routing miller of conventional structure.

Figure 4:
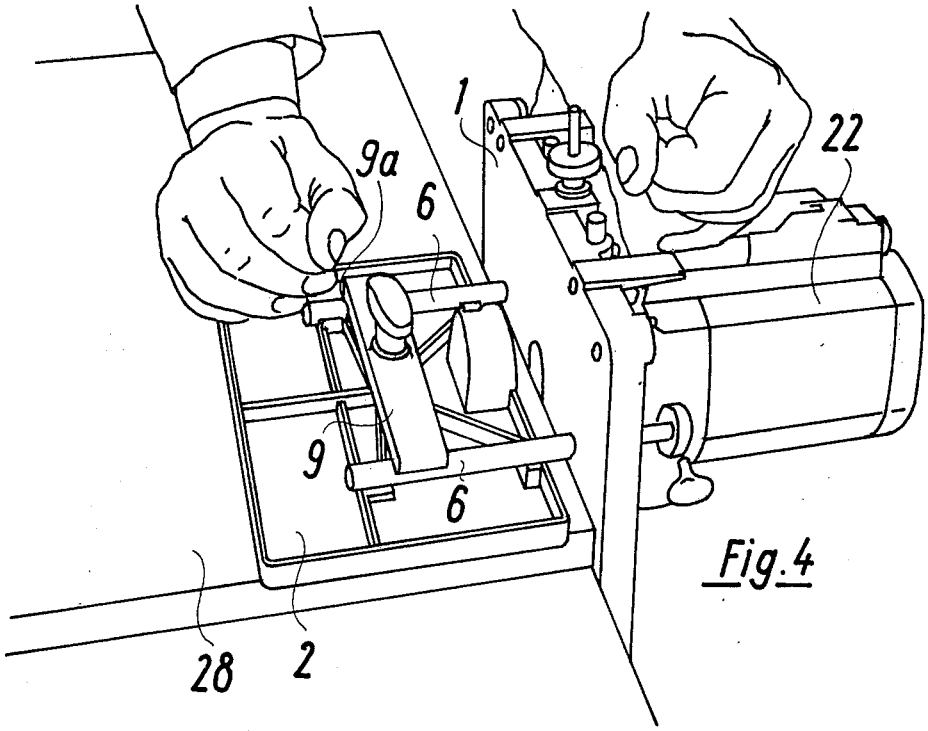
FIG. 4 is a schematic perspective view which shows the novel angular guide when used in the machining of a panel edge, wherein the panel is fixed and the hand routing miller is displaced together with the angular guide.

FIG. 4 shows, first of all, the use of the hand routing miller 22 as a movable machining unit, wherein the stop plate 2 serves as a supporting surface on a panel 28 to be machined, whereas the mounting plate 1 is utilized as an angle stop. It can furthermore be seen from FIG. 4 that the stop plate 2 is arranged, with its lower end face, facing the mounting plate 1, at a spacing from the surface of the mounting plate 1. This displaceability of the stop plate 2 on the pins 6 thus makes it possible to utilize the novel angular guide in the arrangement of FIG. 4 as an angle stop also for the machining of profiles with glue strips and the like.

Figure 5:
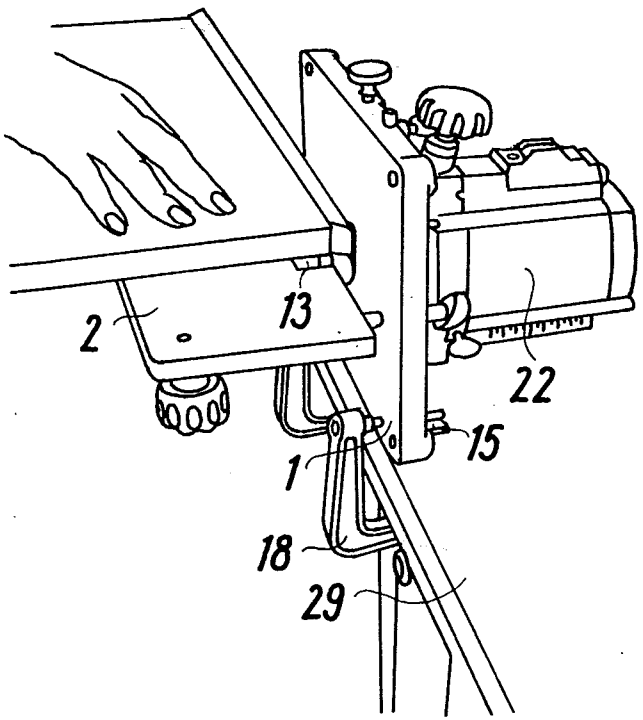
FIG. 5 is a schematic perspective view which shows the stationary arrangement of the angular guide with the hand routing miller by being clamped to a table.

FIG. 5 shows a stationary arrangement of the novel angular guide with the hand routing miller assembly 22. In this figure, the mounting plate 1 is clamped with the aid of clamps 18 with its stabilizing feet 15 to a tabletop 29 so that, in a very simple and efficient manner, panels can be guided on the stop plate which now serves as a table, with their end faces along the mounting plate 1. Since also in this case the stop plate 2— as illustrated — can be arranged at a spacing from the surface of the mounting plate 1, glue strip profiles can also be machined in this way. If the stop plate 2 is firmly joined to the mounting plate 1 with its lower end face, the novel angular guide, in this stationary arrangement, is also suitable, for example, for the machining of fillet profiles which can then be guided manually on the stop plate 2 and on the smooth surface of the mounting plate 1. It is, of course, also possible to guide panels in an upright position in this mode of operation.

Figure 6:
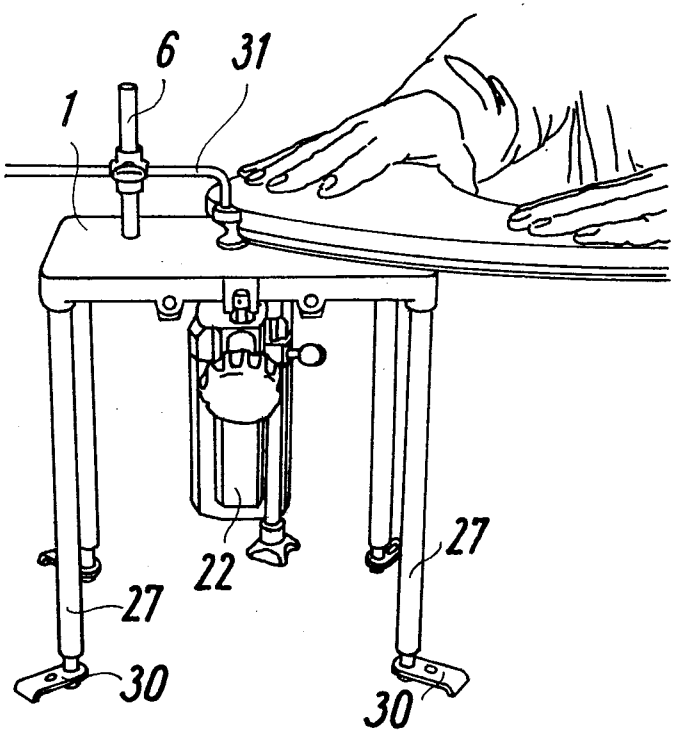
FIG. 6 is a schematic perspective view which shows the stationary arrangement of the hand routing miller on the mounting plate utilized as the machining table, with the stop plate being removed.

Finally, it can be seen from FIG. 6 that, after the stop plate 2 has been removed, i.e., after the mounting bolts 6 have been detached, the mounting plate 1 can serve as a machining tabletop if the stabilizing columns 27 are introduced into the blind holes 25 provided for this purpose and are fixed with their other ends to a tabletop or the like by means of appropriate claws 30. In this case, it is possible when arranging one of the bolts 6 in an additional bore in the mounting plate 1 and when providing a suitable roller guide 31 to effect also circular or arcuate machining procedures.

Consequently, the novel angular guide constitutes an accessory part for hand routing millers which is very lightweight and simple in its construction, but which decisively broadens the field of utility of protable hand routing millers.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Angular guide for hand routing millers, comprising two legs forming an angle with each other, one of these legs being fashioned as a stop plate with a smooth guiding surface, and the other of these legs being constructed as a mounting plate with holding members arranged on its outside for the routing miller, both of these legs being provided, in the zone of the apex of the angle, with apertures to pass the milling tool therethrough, wherein the leg fashioned as the mounting plate is extended beyond the apex and is likewise formed as a guiding surface at least on the side facing the smooth guiding surface of the stop plate, wherein the mounting means for the routing miller include a pair of rods extending in parallel to each other and attached on both sides to the mounting plate; and wherein recesses are provided at the extended leg portion of the mounting plate between mounting eyes provided for these rods, for receiving a setscrew mounted in parallel to the rods for displacing the routing miller on the rods for the purpose of adjusting the cutting depth.

2. Angular guide according to claim 1, wherein said angle is 90°.

3. Angular guide according to claim 2, wherein the stop plate is detachably mounted to the mounting plate, the latter being provided, at least on one of its end faces extending in parallel to the stop plate, with supporting surfaces for the setup and clamping mounting on and to a workbench or the like.

4. Angular guide according to claim 3, wherein the supporting surfaces are fashioned as stabilizing feet unilaterally projecting toward the side oppositely to the stop plate.

5. Angular guide according to claim 1, wherein the aperture for the milling tool is arranged approximately in the center of the mounting plate, and wherein connection provisions for at least three stabilizing columns are provided at the side of the mounting plate facing away from the stop plate.

6. Angular guide according to claim 3, wherein the aperture for the milling tool is arranged approximately in the center of the mounting plate, and wherein connection provisions for at least three stabilizing columns are provided at the side of the mounting plate facing away from the stop plate.

7. Angular guide according to claim 5, wherein the connection provisions are fashioned as blind holes.

8. Angular guide according to claim 6, wherein the connection provisions are fashioned as blind holes.

9. Angular guide according to claim 1, wherein bolts are provided for mounting the stop plate, these bolts being arranged on one side of the mounting plate, the stop plate being clamped thereto.

10. Angular guide according to claim 9, wherein the bolts are inserted, with a threaded pin of the bolts, in bores of the mounting plate.

11. Angular guide according to claim 10, characterized in that the threaded pins of the bolts extend through the mounting plate and are threadedly joined with wing nuts on the backside.

12. Angular guide according to claim 1, wherein the stop plate is clamped to bolts disposed on the mounting plate and is equipped with a manually engageable handle, and wherein at least one prismatic guide for one of the bolts and a clamping brackets for mounting to the bolt is provided at the side of the stop plate equipped with the handle.

13. Angular guide according to claim 12, wherein a prismatic guide for a bolt is likewise provided at one end of the bracket.

14. Angular guide according to claim 1, wherein the stop plate has a protective hood projecting over the aperture for the cutter.

15. Angular guide according to claim 14, wherein said protective hood is integrally formed with said stop plate.

16. Angular guide according to claim 14, wherein the stop plate is equipped with a manually engageable handle at the side thereof containing said hood.

17. Angular guide according to claim 1, wherein each of said stop and mounting plates are provided with reinforcing ribs at the side thereof facing away from their respective smooth guiding surfaces.

18. Angular guide for hand routing millers, comprising two legs forming an angle with each other, one of these legs being fashioned as a stop plate with a smooth guiding surface, and the other of these legs being constructed as a mounting plate with holding members arranged on its outside for the routing miller, both of these legs being provided, in the zone of the apex of the angle, with apertures to pass the milling tool therethrough, wherein the leg fashioned as the mounting plate is extended beyond the apex and is likewise formed as a guiding surface at least on the side facing the smooth guiding surface of the stop plate, wherein bolts are provided for mounting the stop plate, these bolts being arranged on one side of the mounting plate, the stop plate being clamped therto, and wherein the stop plate is equipped with a manually engageable handle, and wherein the stop plate is equipped with a manually engageable handle, and wherein at least one primatic guide for one of the bolts and a clamping bracket for mounting to the bolt is provided at the side of the stop plate equipped with the handle.

19. Angular guide according to claim 18 wherein the clamping bracket is seated on a threaded pin by means of a wing nut in its center, this pin being mounted to the stop plate, the clamping bracket extending across the bolts with both ends.

20. Angular guide according to claim 19, wherein a prismatic guide for a bolt is likewise provided at one end of the bracket.

21. Angular guide according to claim 20, wherein the stop plate has a protective hood projecting over the aperture for the cutter.

22. Angular guide for hand routing millers, comprising two legs forming an angule with each other, one of these legs being fashioned as a stop plate with a smooth guiding surface, and the other of these legs being constructed as a mounting plate with holding members arranged on its outside for the routing miller, both of these legs being provided, in the zone of the apex of the angle, with apertures to pass the milling tool therethrough, wherein the leg fashioned as the mounting plate is extended beyond the apex and is likewise formed as a guiding surface at least on the side facing the smooth guiding surface of the stop plate, wherein the stop plate is clamped to bolts disposed on the mounting plate and is equipped with a manually engageable handle, and wherein at least one prismatic guide for one of the bolts and a clamping bracket for mounting to the bolt is provided at the side of the stop place equipped with the handle, and wherein the clamping bracket is seated on a threaded pin by means of a wing nut in its center, this pin being mounted to the stop plate, the clamping bracket extending across the bolts with both ends.

23. Angular guide for hand routing millers, comprising two legs forming an angule with each other, one of these legs being fashioned as a stop plate with a smooth guiding surface, and the other of these legs being constructed as a mounting plate with holding members arranged on its outside for the routing miller, both of these legs being provided, in the zone of the apex of the angle, with apertures to pass the milling tool therethrough, wherein the leg fashioned as the mounting plate is extended beyond the apex and is likewise formed as a guiding surface at least on the side facing the smooth guiding surface of the stop plate, wherein the mounting means for the routing miller include a pair of guide means extending in parallel to each other and attached on both sides to the mounting plate; and wherein recesses are mounted at the extended leg portion of the mounting plate between mounting eyes provided for these guide means, for receiving an adjustment means mounted in parallel to the guide means for displacing the routing miller along the guide means for the purpose of adjusting the cutting depth.

24. Angular guide according to claim 23, wherein the apperture for the milling tool is arranged approximately in the center of the mounting plate, and wherein connection provisions for at least three stablizing columns are provided at the side of the mounting plate facing away from the stop plate.

* * * * *